US006846981B2

(12) United States Patent
Devers

(10) Patent No.: US 6,846,981 B2
(45) Date of Patent: Jan. 25, 2005

(54) ELECTROMAGNETIC HUMBUCKER PICK-UP FOR STRINGED MUSICAL INSTRUMENTS

(76) Inventor: David George Devers, P.O. Box 131, Kingsbury, VIC, 3083 (AU)

( * ) Notice: Subject to any disclaimer, the term of this patent is extended or adjusted under 35 U.S.C. 154(b) by 446 days.

(21) Appl. No.: 09/816,202

(22) Filed: Mar. 26, 2001

(65) Prior Publication Data

US 2002/0020281 A1 Feb. 21, 2002

(30) Foreign Application Priority Data

May 17, 1999 (AU) ..... PQ0385
May 23, 2000 (GB) ..... 0012307
May 19, 2000 (AU) ..... 35385100

(51) Int. Cl.[7] ..... G10H 3/18
(52) U.S. Cl. ..... 84/728
(58) Field of Search ..... 84/725–728

(56) References Cited

U.S. PATENT DOCUMENTS 4,442,749 A * 4/1984 DiMarzio et al. ..... 84/728
5,668,520 A * 9/1997 Kinman ..... 336/84 R
5,811,710 A * 9/1998 Blucher et al. ..... 84/728
5,949,014 A * 9/1999 Rashak et al. ..... 84/723
6,291,759 B1 * 9/2001 Turner ..... 336/110

* cited by examiner

*Primary Examiner*—Jeffrey Donels

(57) ABSTRACT

An electromagnetic Humbucker Pick-up for stringed musical instruments is disclosed. The device is a former (7) with two coils of wire (3) & (4) wound on having a common axis perpendicular to a set of ferrous strings (13), the first coil of wire (3) is directly beneath the strings (13), the second coil of wire (4) is beneath the first coil of wire (3). Two permanent magnet means (1) & (2) generating opposing magnetic fields (5) & (6). The first permanent magnet means (1) is magnetically polarized in the opposite direction to that of the second permanent magnet means (2). The two permanent magnet means (1) & (2) are situated across the center of the former (7). The first permanent magnet means (1) is in the center of the first coil of wire (3) and the second permanent magnet means (2) is in the center of the second coil of wire (4).

21 Claims, 22 Drawing Sheets

ELECTROMAGNETIC HUMBUCKER PICK-UP FOR STRINGED MUSICAL INSTRUMENTS

BACKGROUND OF THE INVENTION

This invention relates to improvements in picks for picking up the sound from musical instruments and converting that sound into an electrical signal, otherwise known as a pick-up. (humbucker guitar pick-ups).

A single-coil pick-up consists of a magnet with a coil around it or a number of magnets with a coil around them.

1950's design type humbucker pick-ups consist of either a flat bar magnet with pole pieces that are magnetic flux conductors (ie ferrous screws or slugs) placed at right angles to the magnet, on each end of the bar magnet (on the south pole and on the north pole of the magnet, bringing a south pole & a north pole up to the strings). There is a coil around the pole pieces on the south pole and a coil around the pole pieces on the north pole. These coils are connected out-of-phase thus canceling electrical noise; they are also magnetically out-of-phase which puts the signal generated from the strings "string-signal", back in-phase.

Another way is the double humbucker where two single-coil pick-ups with magnets through the centers of their coils, are placed right next to each other side by side, one with the south poles facing the strings and one with the north poles facing the strings. Again the coils are wired out-of-phase thus canceling electrical noise but not the string-signal, in the same way as the pick-up described above.

The split humbucking configuration type pick-up like that seen on some base guitars, consists of two pick-ups in one. One half is placed under the E and A strings, the other half under the D and G strings. The two halves are wired out-of-phase (180 degrees ) to cancel electrical noise.

There are some relatively new humbucker pick-ups using an "EMF-coil" eg a coil that is designed and situated as to pickup electro magnetic field waves EMF (hum) and not the "string-signal", signals produced by the strings only. The "EMF-coil" is placed next to a "signal-coil" eg a coil that is designed to pickup both string-signal and EMF (hum).

One type, the "active isolation blocking" type humbucker pick-up, consists of an EMF-coil next to a signal-coil and two pre-amplifiers or buffers. The signal from the EMF-coil is fed to one pre-amplifier and the signal from the signal-coil is fed to the other pre-amplifier, then the output of the two pre-amplifiers is mixed together out-of-phase thus canceling the electrical noise.

Another type, the "passive isolation blocking" type humbucker pick-up, consists of an EMF-coil next to a signal-coil. The EMF-coil can be wired out-of-phase, in parallel or in series acting as a noise suppressive inductance or choke, in series or parallel with the signal-coil, as well as an out-of-phase electrical noise generator to reduce electrical noise.

The disadvantages and problems with all of these pick-ups are as follows:

An electro magnetic field "EMF" is generated by anything and everything electrical.

The disadvantage with a single-coil pick-up by itself is that electro magnetic field waves cutting across the pick-up's coil create electrical noise in the output of the pick-up.

The disadvantage with split humbucking configuration type pick-ups is that they will not work on six-string guitars because the strings are too close together. On a bass guitar there is not much interaction between the two halves, ie the strings over one half will not produce much of a signal in the other half, causing induction loading & some cancellation of harmonics.

The disadvantage with 1950s design type humbucker pick-ups & double humbucker type pick-ups is that unlike single-coil pick-ups where the signal is picked up off the string from a single point, incorporating all of the harmonics. These humbucker pick-ups, pick up the signal over the length of the string where the magnetic field extends from one pole piece or magnet to the other. As the harmonics are out-of-phase at these two points they are suppressed dulling the sound. (anti-nodes & nodes problems)

The disadvantage with humbucking with passive isolation blocking is that EMF-coils pick up EMF & cancel hum & noise, but do not pick up much signal from the string. Any signal they do pick up from the string is out of phase to the signal coming from the signal-coil. To the signal coming from the string or the signal-coil, the EMF-coil is a loading inductance and affects the frequency response & dulls the sound. It is also difficult to create a low resistance/low inductance EMF-coil with the same output as a signal-coil with magnets.

The disadvantage with humbucker pick-ups that use active isolation blocking with pre-amplifiers or buffers is that pre-amplifiers generate noise and batteries or power supplies are needed; there is also the problem of matching the resonance of coils and the problems associated with the amplification or presence of an out-of-phase string-signal.

Another problem with both passive and active isolation blocking is that a ferrous metal plate placed between the two coils is necessary to isolate the EMF-coil from the signal-coil. This plate strengthens the magnetic flux and pulls on the guitar strings stopping them from sustaining. In pick-ups with separate magnets under each string the flux varies creating a shape & pattern. When a string is played and bent, it moves through the flux pattern, changing the tone of the note. This plate also changes the shape of the magnetic flux making the flux more constant over and across the top of the pick-up, thus reducing the change in tone as strings are bent.

SUMMARY OF THE INVENTION

These problems associated with existing humbucker pick-ups and single-coil pick-ups are overcome by the present invention and are as follows.

The problems with single-coil pick-ups are overcome, as the present invention does not pick up hum and noise from external sources, as there are two coils connected out of phase to EMF.

The problems with the 1950's design type humbucker pick-up and the double humbucker pick-up are overcome as the present invention only picks up the signal from a single point on the string, incorporating far more harmonics in the output of the device (ie anti-node and node problems are therefore reduced), (see FIGS. 4C, 5A & 5B).

The problems with split humbucking configuration type pick-ups are overcome as the present invention works on all guitars including bass guitars, and does not suffer from interaction and induction problems between the two coils, as both coils of the present invention pick up and generate a signal from any or all of the strings.

The problems with humbucker pick-ups like the active isolation blocking type are overcome, as the present invention is of passive design and does not require pre-amplifiers or batteries.

The problems associated with both active and passive isolation blocking humbucking are overcome by the present invention and are as follows:

The problems with signal canceling due to phase problems are overcome, as both coils of the present invention generate in phase string-signal.

The problems with dulling of the signal due to induction problems are overcome, as both coils of the present invention generate string-signal.

The problems with loss in sustain of a note played are overcome as the present invention does not require a ferrous metal isolation plate between the two coils that strengthens the magnetic flux.

The problems with loss of a change in tone when a string is bent and moved across the pick-up through the shape of the magnetic flux pattern are overcome, as the present invention does not require a ferrous metal isolation plate between the two coils that changes the shape of the magnetic flux pattern.

In effect the present invention approximates the characteristic sound of a single-coil pick-up with all the hum and noise canceling of a humbucker pick-up.

BRIEF DESCRIPTION OF THE DRAWINGS

Note that a permanent magnet means is referred to as magnets or as magnets plus pole pieces.

FIG. 7A is a circuit diagram representation of a device wherein coil (3), comprises a tapped coil.

FIG. 7B is a circuit diagram representation of a device comprising a tapped coil (3) & a divided coil (4).

FIG. 7C is a circuit diagram representation of a device wherein coil (3), comprises further tapings and coil (4), comprises further tapings.

FIG. 7D is a circuit diagram representation of a device comprising a further divided coil (3) & a further divided coil (4).

FIG. 8A parallel humbucking. FIG. 8B series humbucking. FIG. 8C single-coil pick-up. FIG. 8D out-of-phase humbucking between bridge & middle pick-ups. FIG. 8E, out-of-phase humbucking between middle & neck pick-ups.

FIG. 11A shows the two sections disassembled FIG. 11B shows the two sections assembled.

FIG. 14A shows the Former (7), disassembled. FIG. 14B shows the former (7), assembled.

DETAILED DESCRIPTION OF THE INVENTION

Figure 1A:
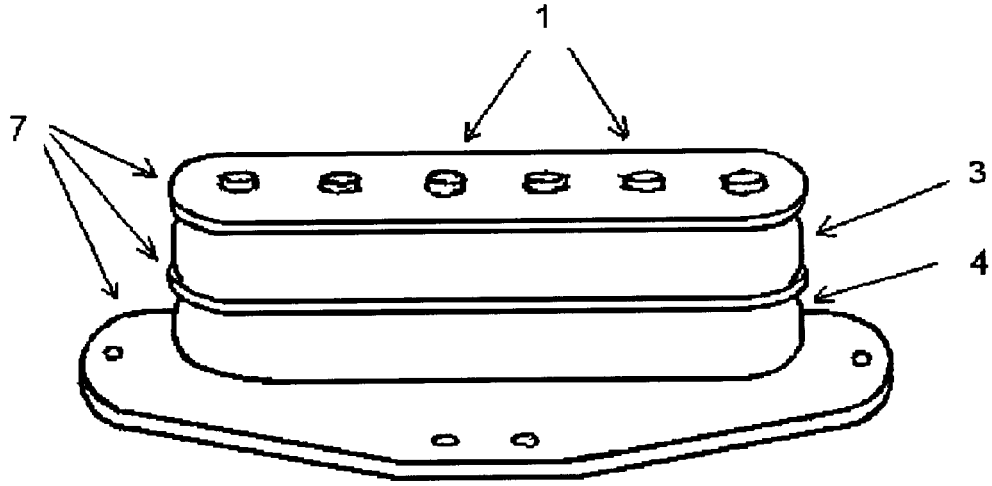
FIG. 1A illustrates a three dimensional view of a pick-up wherein the permanent magnet means incorporates a plural of permanent magnets. The permanent magnet means thereof may incorporate pole pieces or may not incorporate pole pieces.
Figure 1B:
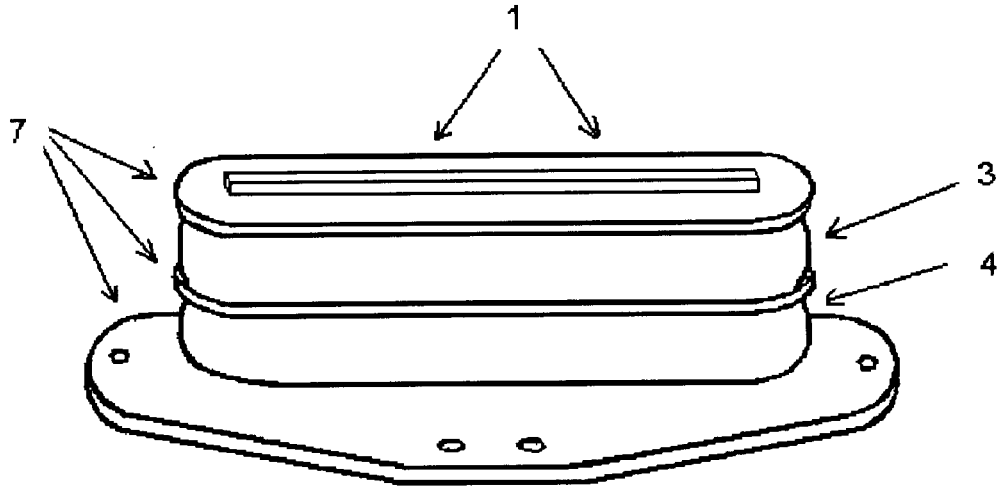
FIG. 1B illustrates a three dimensional view of a pick-up wherein a first permanent magnet means incorporates only one magnet and a second permanent magnet means incorporates only one magnet. Either permanent magnet means thereof may incorporate pole pieces or may not incorporate pole pieces.

To assist with understanding the invention reference will now be made to the accompanying drawings which show examples of the invention.

The present invention is a electromagnetic Humbucker Pick-up for stringed musical instruments. The structure of the pick-up consists of a first permanent magnet means (1), with a first wire coil means (3) wound around thereof, disposed on top of a second permanent magnet means (2), with a second wire coil means (4) wound around thereof a former (7) is provided as a frame to locate the components thereof, (see FIGS. 1A, 1B, 2D, 2E, 3A & 3B).

The magnetic polarization of the first permanent magnet means substantially opposes the magnetic polarization of the second permanent magnet means thereof.

Figure 4B:
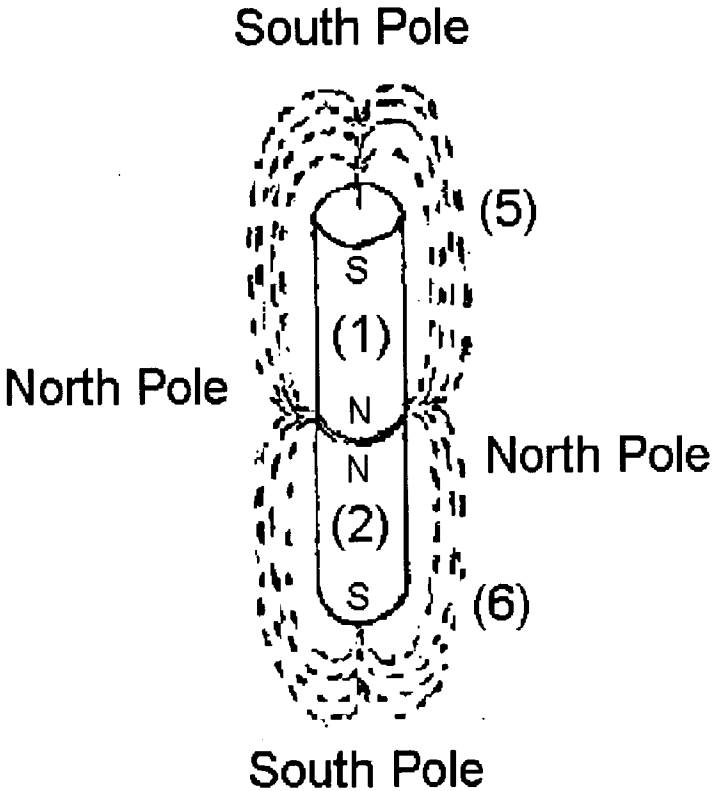
FIG. 4B illustrates three dimensionally permanent magnet means (1) sandwiched against permanent magnet means (2) and their opposing magnetic fields (5) & (6).
Figure 4A:
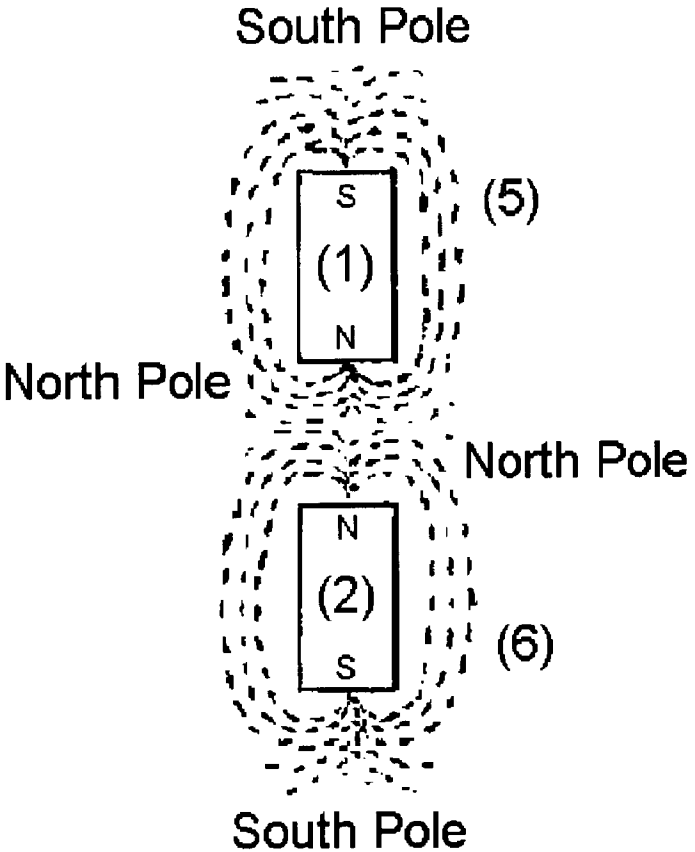
FIG. 4A illustrates the magnetic field (5) generated by permanent magnet means (1) opposing the magnetic field (6) generated by permanent magnet means (2).
Figure 4C:
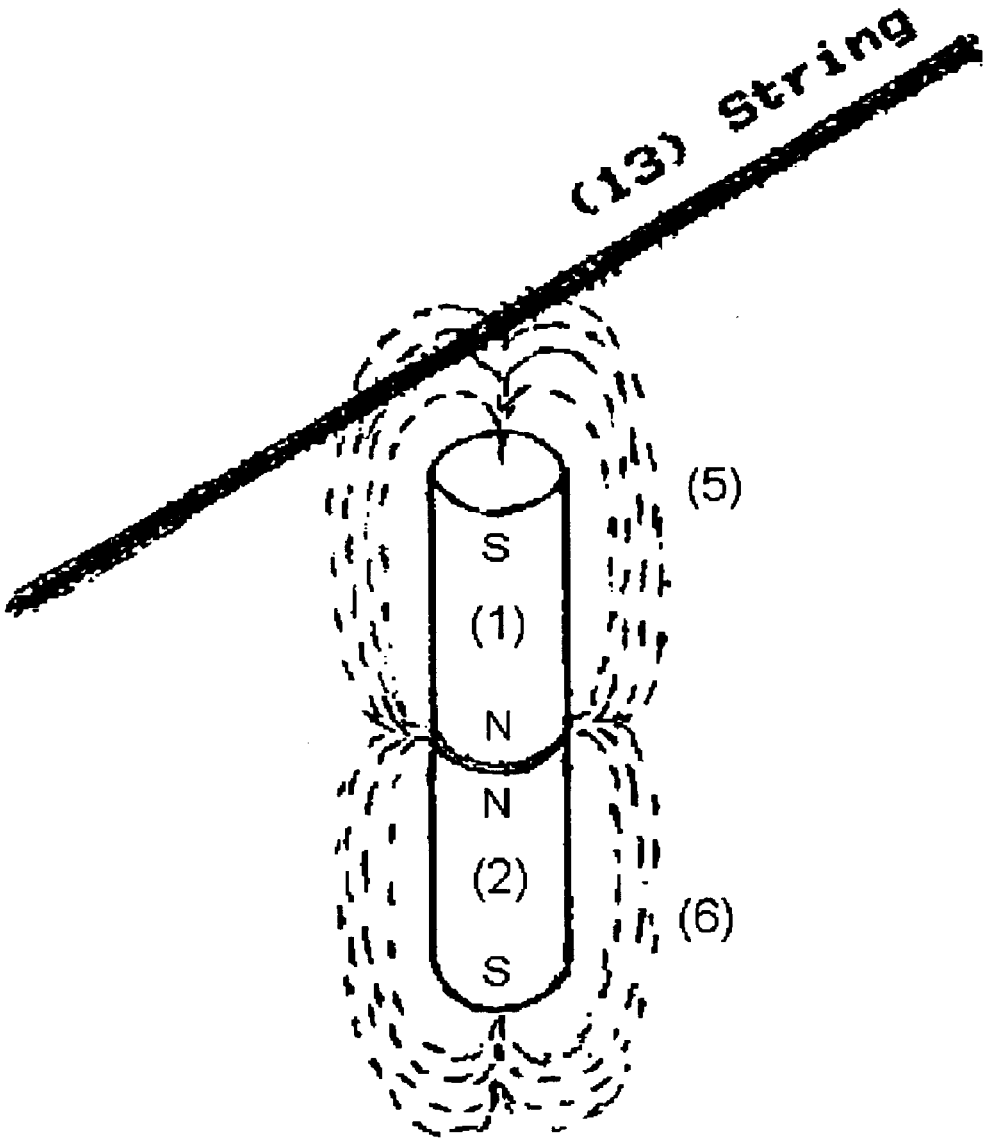
FIG. 4C illustrates permanent magnet means (1) & permanent magnet means (2), with associated magnetic fields (5) & (6) disposed beneath one string (13).

The first permanent magnet means substantially generating a first magnetic field (5) thereof, and the second permanent magnet means substantially generating a second magnetic field (6) thereof, (see FIGS. 4A, 4B & 4C).

Figure 5A:
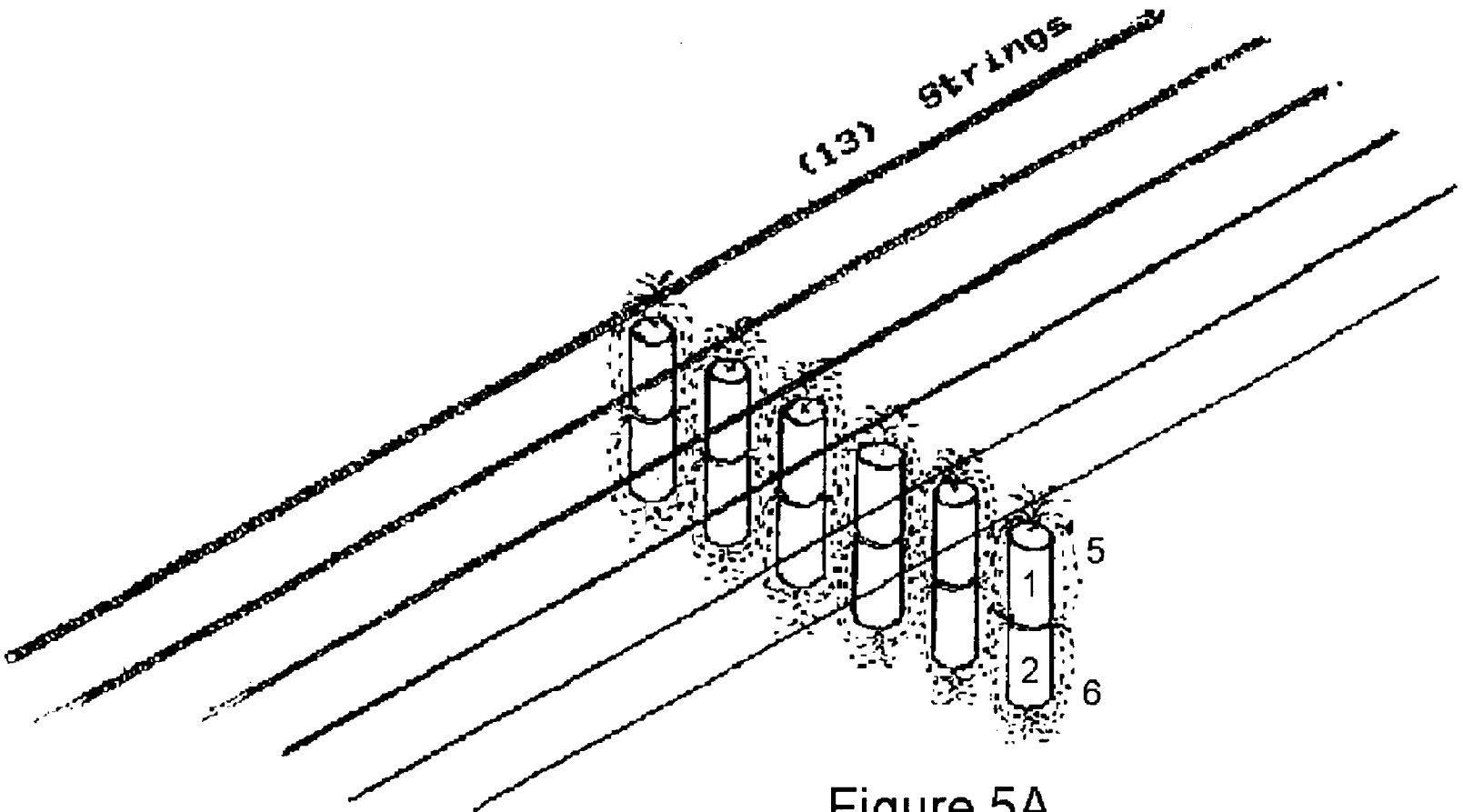
FIG. 5A illustrates permanent magnet means (1) & permanent magnet means (2), with associated magnetic fields (5) & (6) disposed beneath strings (13).
Figure 5B:
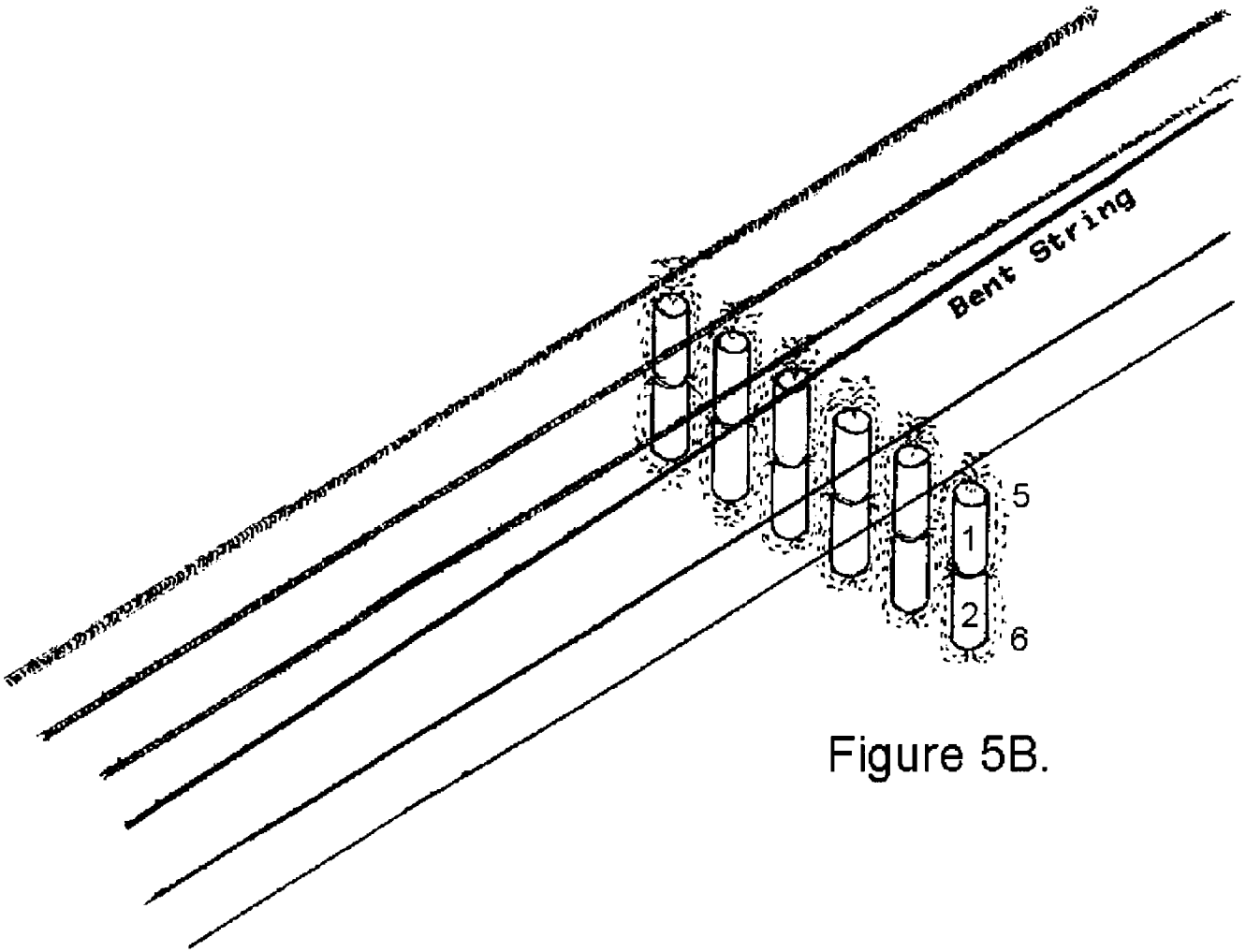
FIG. 5B illustrates permanent magnet means (1) & permanent magnet means (2), with associated magnetic fields (5) & (6) disposed beneath strings (13), wherein one of the strings is bent and moved through the magnetic fields (5).

The first permanent magnet means (1) and second permanent magnet means (2) are situated beneath ferrous strings (13) in a way that only the magnetic flux (5) of said first permanent magnet means (1) thereof reaches out to the said strings (13), (see FIGS. 4C, 5A, & 5B).

The first said wire coil means and second said wire coil means having a common axis perpendicular to said strings (13) thereof.

Either or both permanent magnet means may comprise a plural of permanent magnets arranged in spaced relationship to the strings.

Either or both permanent magnet means may comprise a plural of permanent magnets having ferrous pole pieces disposed coaxially on either or both magnetic poles thereof, arranged in spaced relationship to the strings.

Either or both permanent magnet means may comprise a plural of permanent magnets disposed in pairs with parallel axis thereof, arranged in spaced relationship to the strings.

Either or both permanent magnet means may comprise a plural of permanent magnets having ferrous pole pieces disposed coaxially on either or both magnetic poles thereof, disposed in pairs with parallel axis thereof, arranged in spaced relationship to the strings.

Either or both permanent magnet means may comprise a single permanent magnet elongated across the strings.

Either or both permanent magnet means may comprise a single permanent magnet having a ferrous pole piece disposed on either or both magnetic poles thereof, elongated across the strings.

The principals for the device to operate are as follows:

A first permanent magnet means (1) generates a first magnetic field (5), a second permanent magnet means (2) generates a second magnetic field (6) the polarization of the first magnetic field (5) substantially opposes the polarization the second magnetic field (6), (see FIGS. 4A & 4B).

The first magnetic field (5) is closest to the strings (13) and the second magnetic field (6) is furthest from the strings (13), (see FIGS. 4C, 5A &5B).

The first wire coil means (3) will now be referred to as first coil (3). The second wire coil means (4) will now be referred to as coil (4).

Strings (13) incorporate ferrous metal, when a vibrating string (13) cuts through the first magnetic field (5) a fluctuation is created in the first magnetic field (5) this fluctuation interacts with the second magnetic field (6) and the fluctuation is substantially relayed through into the second magnetic field (6).

The fluctuation in the first magnetic field (5) interacts with the first Coil (3) and produces an alternating current in the first coil (3). The fluctuation in the second magnetic field (6) interacts with the second coil (4) and produces a alternating current in the second coil (4).

Figure 6A:
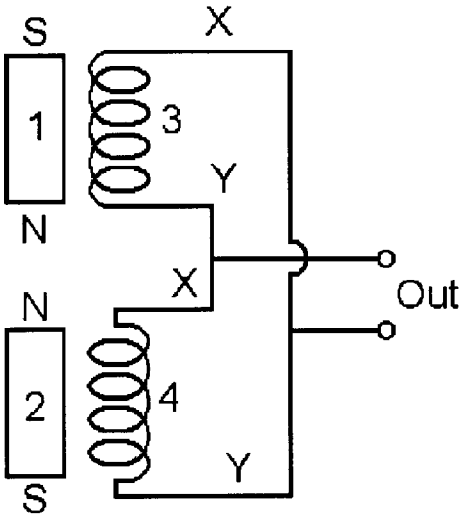
FIG. 6A illustrates a circuit diagram representation of the device wherein coil (3) & coil (4) are connected in parallel. X & Y are shown to demonstrate the phases.
Figure 6B:
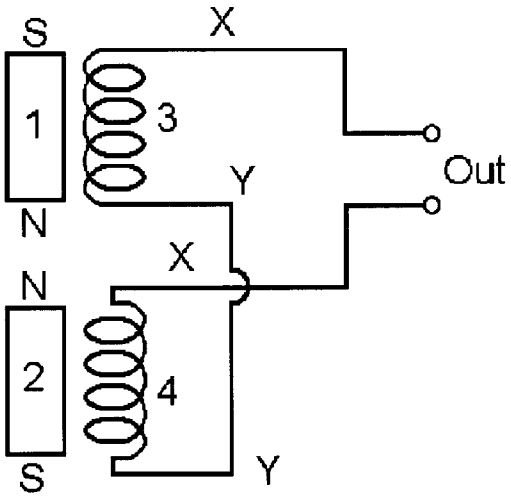
FIG. 6B illustrates a circuit diagram representation of the device wherein coil (3) & coil (4) are connected in series. X & Y are shown to demonstrate the phases
Figure 6C:
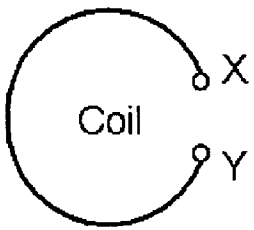
FIG. 6C illustrates a technical type representation of either of the coils (3) or (4) X & Y is shown to demonstrate the phase

The first coil (3) and the second coil (4) can be wired out-of-phase with each other to EMF, either in-series or in-parallel, (see FIGS. 6A & 6B).

As first coil (3) is out-of-phase with second coil (4) to any external magnetic wave cutting across the pick-up, the EMF signals are canceled out.

As the polarization of the first magnetic field (5) opposes the polarization of the second magnetic field (6), the first coil (3) is in-phase with the second coil (4) to fluctuations in the first magnetic field (5) and the second magnetic field (6).

Thus the signal output of the pick-up is predominantly that of the vibrating string with minimal EMF noise.

Note that by using a different number of turns, a different gauge of wire, magnets of a different permeability and magnetic pole pieces of different permeability, in the upper section than those in the lower section of the device, will give closer matching of string-signal to EMF ratio in the outputs of the two coils, in order to optimize frequency characteristics of string-signal & EMF noise canceling.

Note that any induction loading between the two coils (3) & (4) may be further reduced with active circuits by feeding the output of each coil into separate inputs of a differential amplifier. This is deemed to be within the scope of the present invention.

Note that three or four or more opposing permanent magnet means cascaded one on top of the other, creating three or four or more opposing magnetic fields, with an associated coil wound around each permanent magnet means functioning in the same manner as the above is possible. This is also deemed to be within the scope of the present invention.

Note that the dimensional proportions of the device shown in the drawings are for demonstration purposes only, and that any dimensional proportions are deemed to be within the scope of the present invention.

To add to the performance and versatility of the pick-up, the first coil (3) may be tapped or divided into a plural of coils &/or the second coil (4) may be tapped or divided into a plural of coils, (see FIGS. 7A, 7B 7C & 7D). In doing this, features are added to the pick-up, such as two coil parallel humbucking, two coil series humbucking, single-coil pick-up and phase humbucking between two single-coil pick-ups, all with outputs that are matched to the same level.

An example for the number of turns to match the available string-signal at the three pick-up positions used on a guitar are as follows:

15000 (3) & (4) bridge position parallel humbucker.

12750 (3) & (4) middle position parallel humbucker.

12000 (3) & (4) neck position parallel humbucker.

7500 (3) & (4) bridge position series humbucker.

6375 (3) & (4) middle position series humbucker.

6000 (3) & (4) neck position series humbucker.

7500 (3) bridge position single-coil pick-up.

6375 (3) middle position single-coil pick-up.

6000 (3) neck position single-coil pick-up.

It may be impractical to incorporate all these taps & coils on just one pick-up, although pick-ups of this nature are deemed to be within the scope of the present invention.

Typical configurations for practical designs are as follows.

Bridge pick-up
First Coil (3) taps. 15000, 12750, 7500 turns.
Second Coil (4) divided into two coils 7500 turns each.

Middle pick-up
First Coil (3) taps. 12750, 12000, 6375 turns.
Second Coil (4) divided into two coils 6375 turns each.

Neck pick-up
First Coil (3) taps. 12000, 6000 turns.
Second Coil (4) divided into two coils 6000 turns each.

For a typical parallel humbucking configuration the tap for the maximum number of turns on first coil (3) is connected to ground and the other end connected to hot. The two coils in the second coil (4) are connected together in-series forming a coil with the same number of turns as the first coil (3), this coil and the first coil (3) are connected in-parallel, (see FIG. 8A).

Figure 8B:
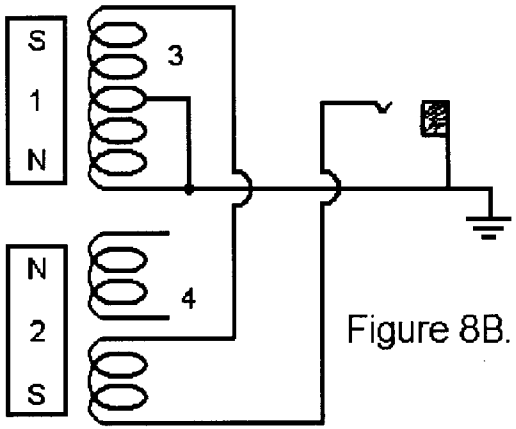
FIGS. 8A to 8E illustrate circuit diagrams of various pick-up configurations.
Figure 8A:
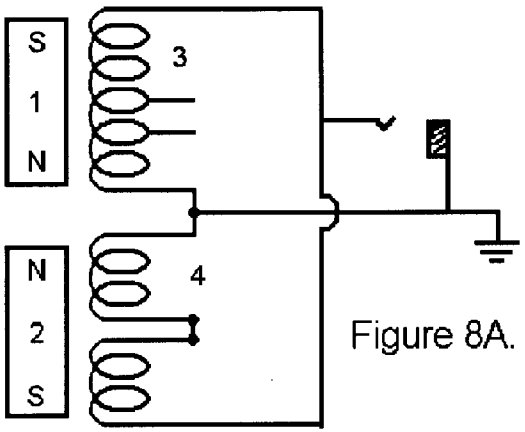

For a typical series humbucking configuration the center tap of the first coil (3) is connected to ground and either end connected to one of the coils in the second coil (4) the other end of this coil is connected to hot, (see FIG. 8B). This configuration would mostly be utilized on the neck pick-up eliminating the necessity for a division of the second coil (4) in the middle & bridge pick-ups.

Figure 8C:
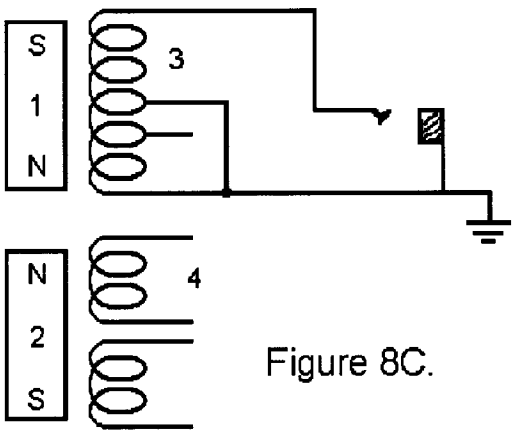

For a single-coil pick-up only the first coil (3) is necessary, the center tap is connected to ground and either end is connected to hot, (see FIG. 8C).

Parallel out-of-phase humbucking between two single-coil pick-ups:

For better results the middle pick-up may be wound in the opposite direction to the other pick-ups, although this is not essential.

The middle pick-up is connected out-of-phase to the other pick-ups with respect to String-signal and EMF.

Figure 8E:
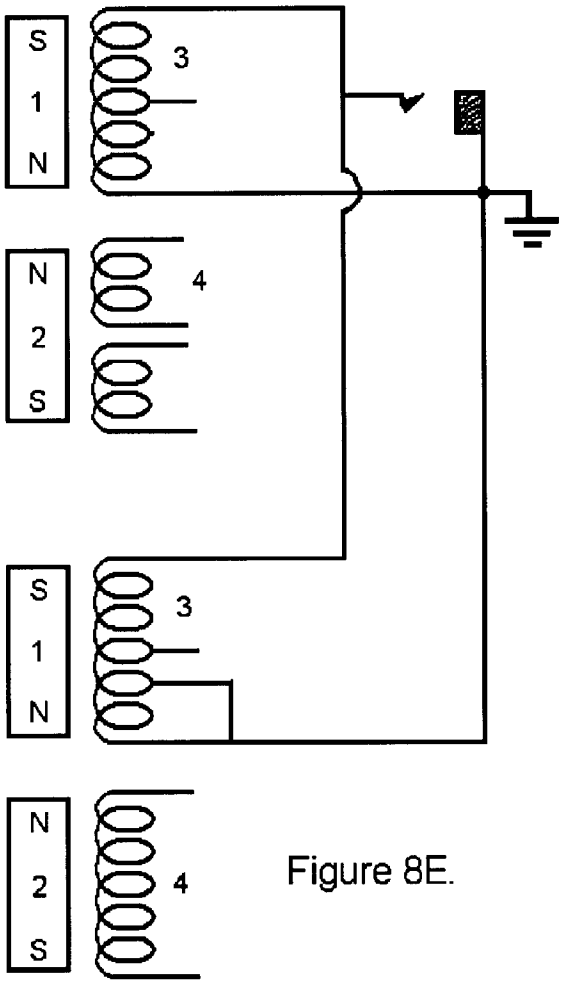
Figure 8D:
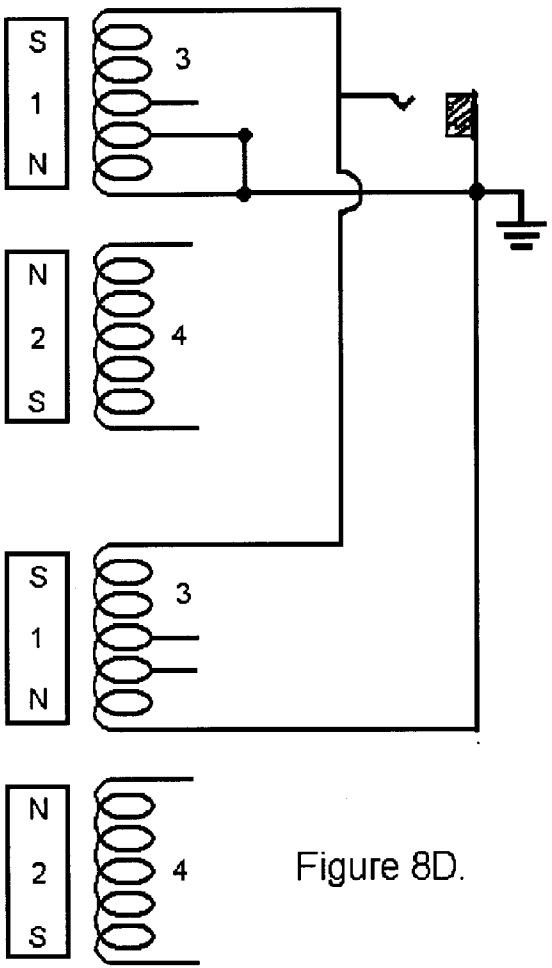

For out-of-phase humbucking between bridge and middle pick-ups the 12750 turn tap on the first coil of the bridge pick-up is connected to ground and the other end to hot. The 12750 turn tap on the first coil of the middle pick-up is connected to ground and the other end to hot, (see FIG. 8D).

For out-of-phase humbucking between middle and neck pick-ups the 12000 turn tap on the first coil of the middle pick-up is connected to ground and the other end to hot. The 12000 turn tap on the first coil of the neck pick-up is connected to ground and the other end to hot, (see FIG. 8E).

Further divisions and/or tapings of the first coil and/or second coil to include extra windings to provide higher output levels to enable boost, overdrive or distortion as well as other functions is possible and deemed to be within the scope of the present invention.

Note that values for the number of turns listed for each wire coil means in the device are example values and that grater values and lesser values perform the same function as those values listed and that any values of numbers of turns are deemed to be within the scope of the present invention.

Figure 17A:
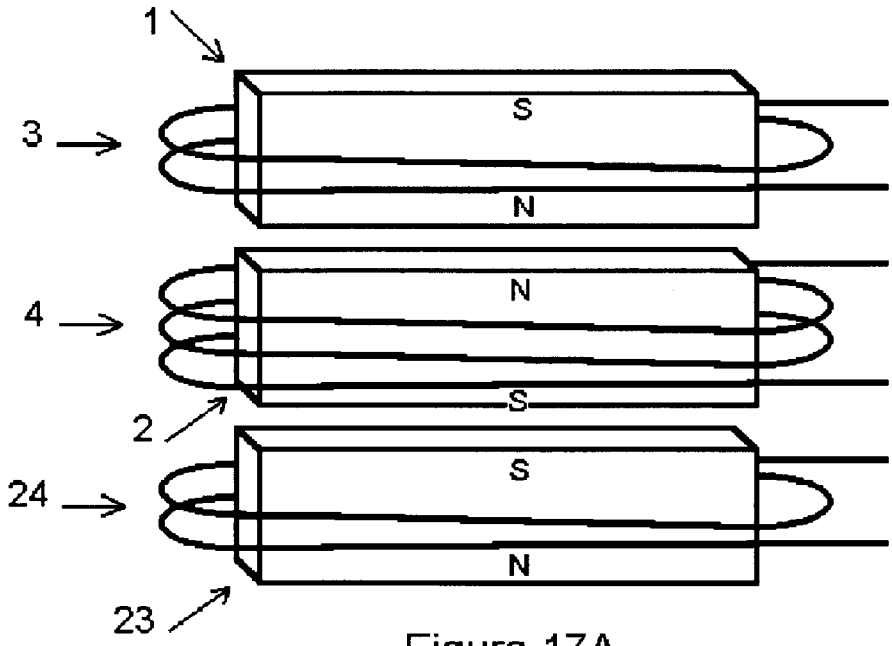
FIG. 17A illustrates a technical type representation of coil (3) around a permanent magnet means (1) and coil (4) around a permanent magnet means (2) and a further cascaded coil around a further cascaded permanent magnet means.
Figure 17B:
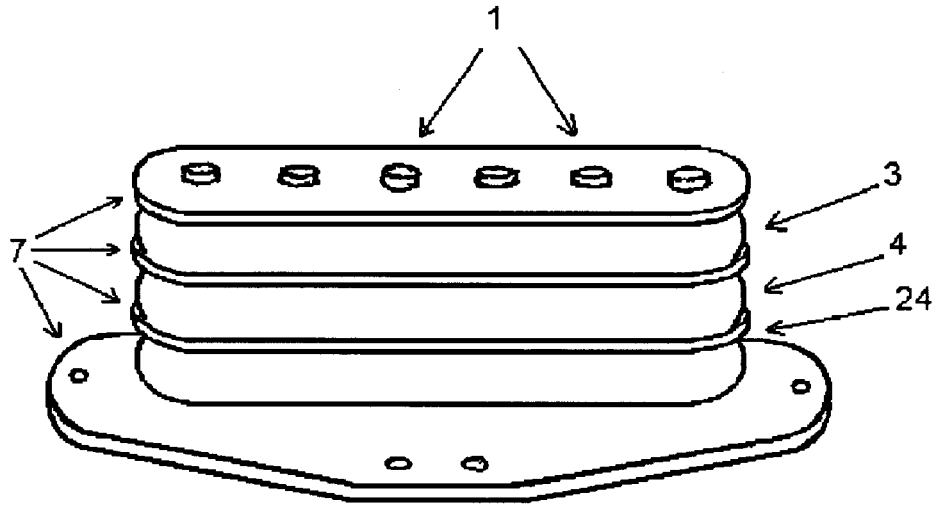
FIG. 17B illustrates a three dimensional view of a pick-up wherein further cascaded coil around a further cascaded permanent magnet means has been added. The permanent magnet means incorporating a plural of permanent magnets. The permanent magnet means thereof may or may not incorporate pole pieces.

As the proximity to the strings of first coil (3) is less than that of the second coil (4), the string-signal output level of the first coil (3) is greater than that of the second coil (4). One method to overcome this problem is by decreasing the number of turns in the first coil (3) so that the output is less than that of the second coil (4), a further coil (24) and permanent magnet means (23), generating an opposing magnetic field that is cascaded beneath the second coil (4), (see FIGS. 17A & 17B). This further cascaded coil (24) and permanent magnet means (23) has the same polarity and phase as the first coil (3) and the number of turns for this coil (24) is the difference between those of the first coil (3) and the second coil (4). The first coil (3) may be connected in series with the further cascaded coil (24) to provide an output level equal in strength to that of the second coil (4). Then the two outputs that are equal in strength may be connected either in-series or in-parallel and either in-phase or out-of-phase.

Any or all of the coils may include equal or greater numbers of turns with tapes and/or coils divided into plurals of coils, to provide the same functions as listed above and is deemed to be within the scope of the present invention.

Figure 2B:
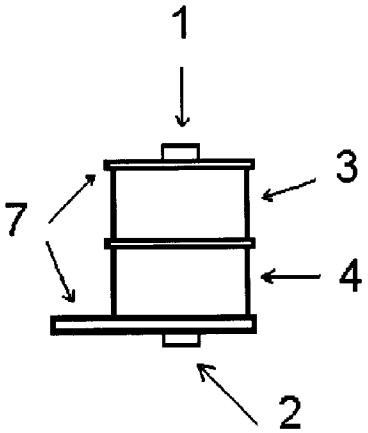
FIG. 2B illustrates an end view of the former (7), with the magnets (1) & (2) inserted and the coils (3) & (4) around the former (7).
Figure 2A:
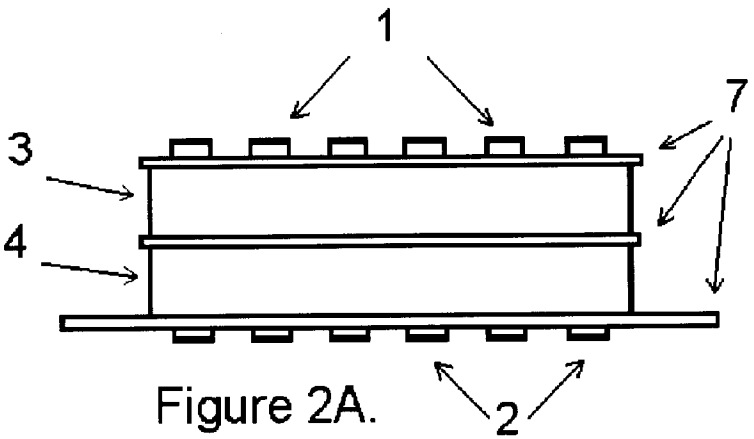
FIG. 2A illustrates a side view of the former (7), with the magnets (1) & (2), inserted and the coils (3) & (4) around the former (7).
Figure 2C:
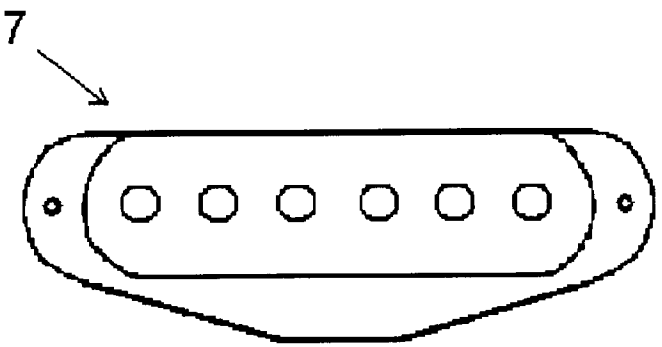
FIG. 2C illustrates a top view of the former (7), with the magnets (1) & (2) inserted and the coils (3) & (4), around the former (7).
Figure 2D:
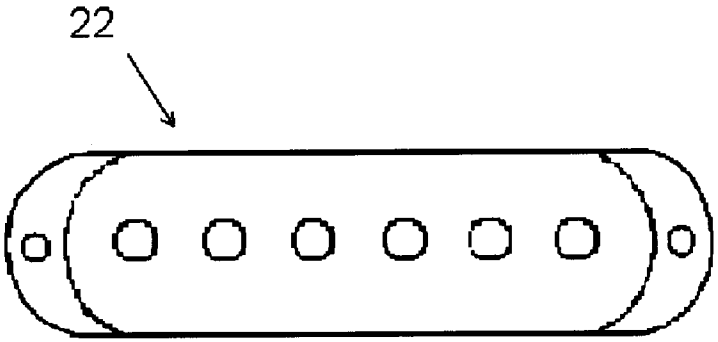
FIG. 2D illustrates a top view of the cover (22), that fits over the former (7), coils (3) & (4), and magnets (1) & (2).
Figure 2E:
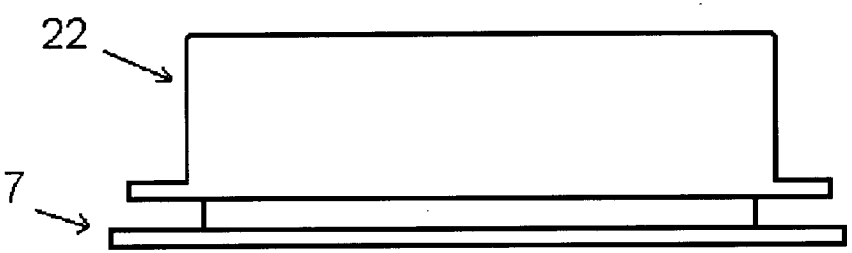
FIG. 2E illustrates a side view of the cover (22), over the former (7), coils (3) & (4) and magnets (1) & (2).
Figure 2F:
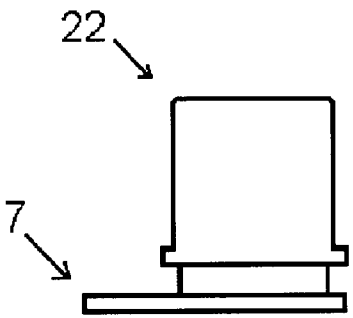
FIG. 2F illustrates an end view of the cover (22), over the former (7), coils (3) & (4) and magnets (1) & (2).
Figure 3A:
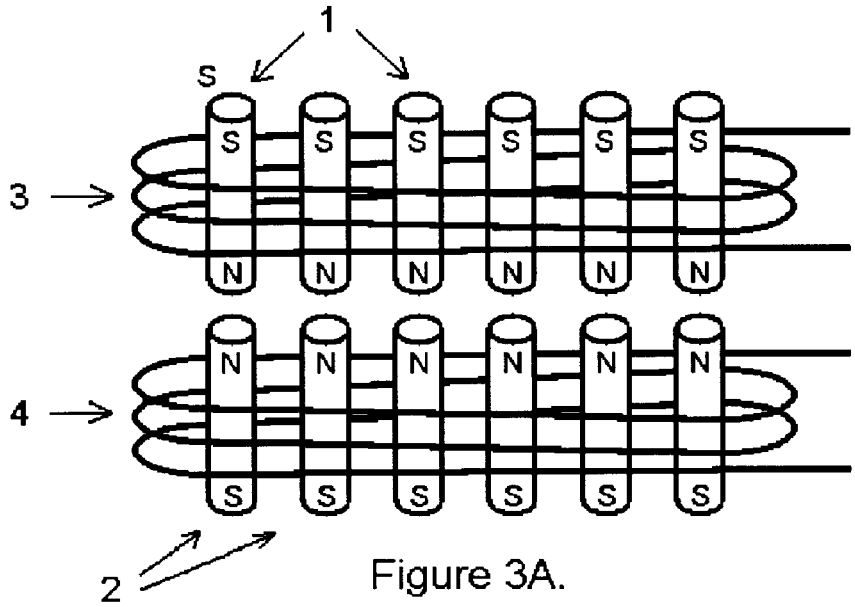
FIG. 3A illustrates a technical type representation of coil (3), around a plural of permanent magnet means (1) and coil (4), around a plural of permanent magnet means (2).
Figure 3B:
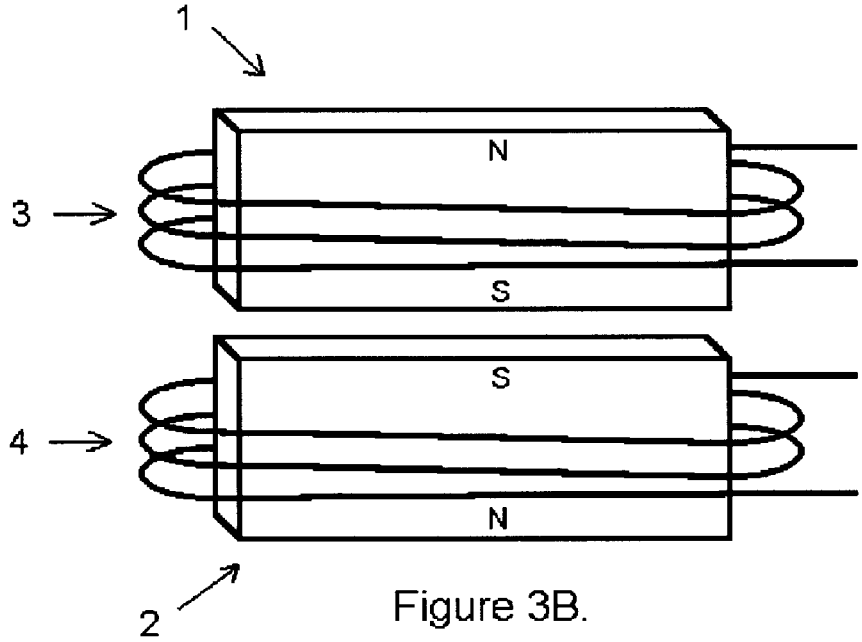
FIG. 3B illustrates a technical type representation of coil (3) around a permanent magnet means (1) and coil (4) around a permanent magnet means (2).
Figure 7B:
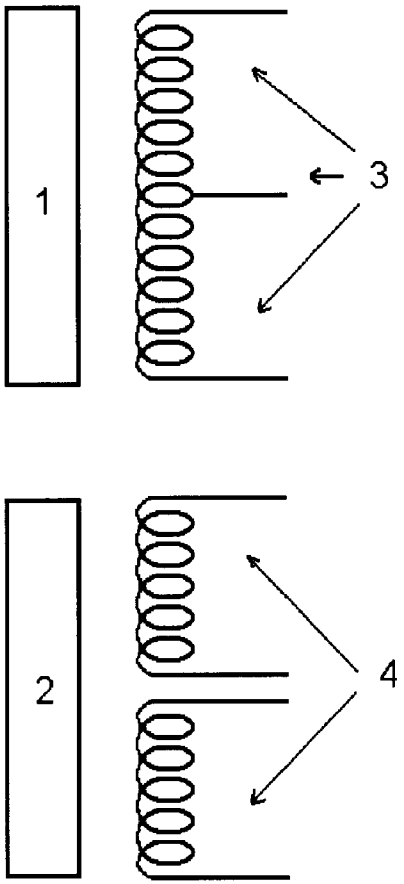
FIGS. 7A to 7D illustrates some of the optional configurations for the first coil (3) and second coil (4).
Figure 7A:
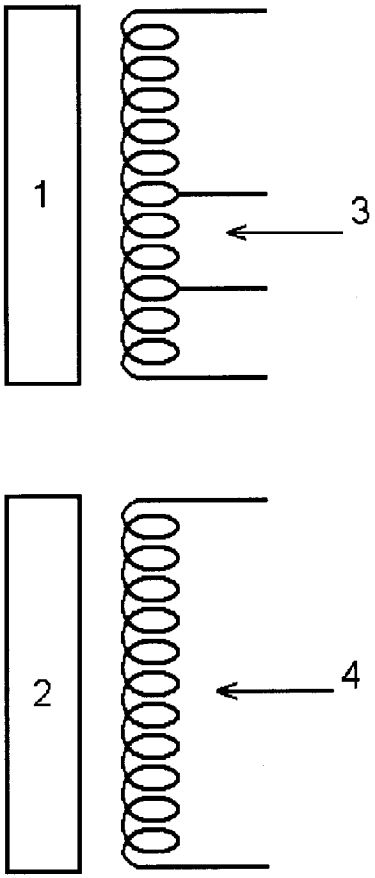
Figure 7C:
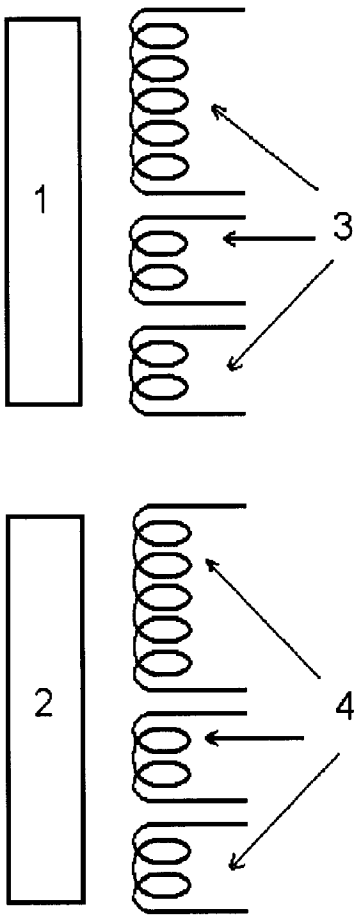
Figure 7D:
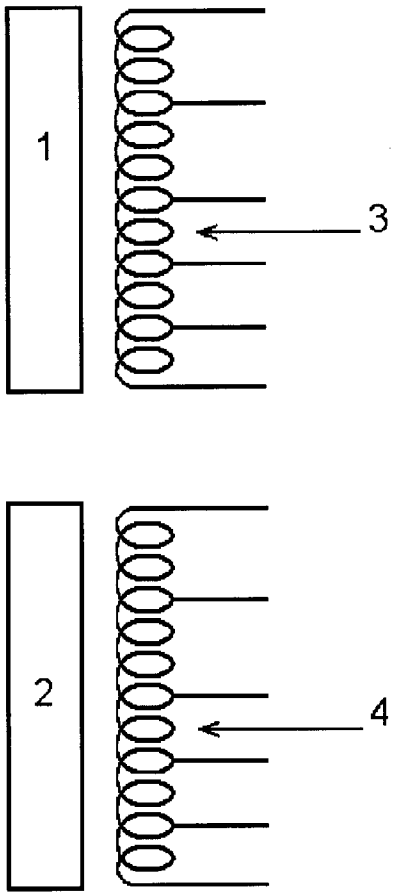
Figure 9A:
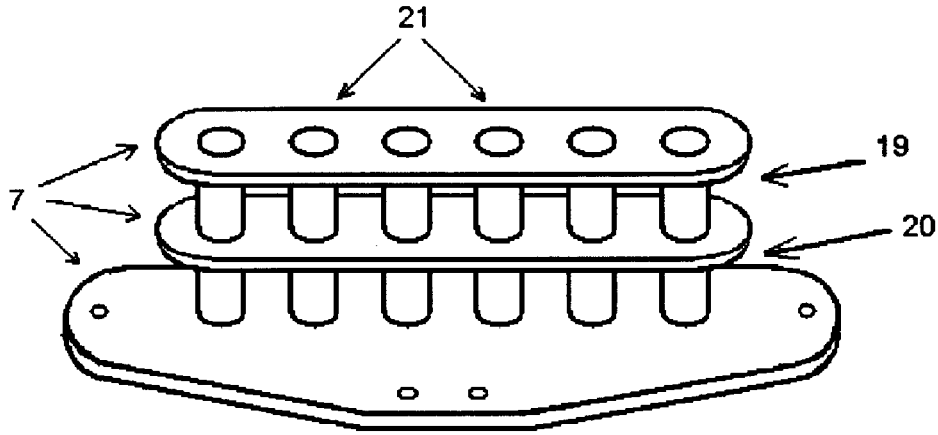
FIG. 9A illustrates three dimensional view of the former (7), showing hiatuses (19) & (20) and holes (21).
Figure 9B:
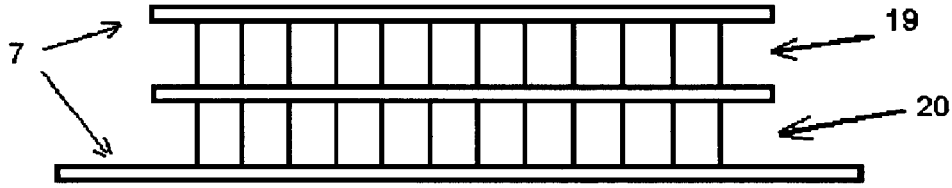
FIG. 9B illustrates a side view of the former (7) showing hiatuses (19) & (20).

In one form of the invention the former (7) is fabricated with holes (21) in a row across the middle and down through the center, (see FIG. 7A). The former (7) is fabricated with a upper cavity (19) and a lower cavity (20), each of the cavities extends in a full circle around the sides & ends of the former (7), (see FIGS. 9A, 9B & 9C). Coil (3) is wound into the cavity (19) & Coil (4) is wound into the cavity (20), (see FIGS. 1A, 2A & 2B).

Figure 9C:
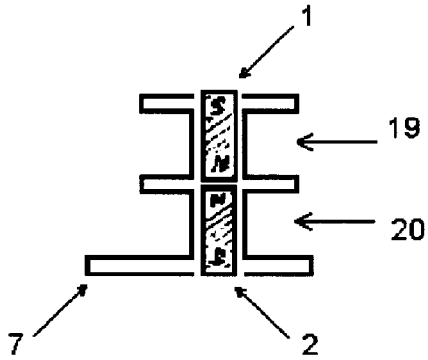
FIG. 9C illustrates an end view of the former (7) with the magnets (1) & (2) inserted and showing hiatuses (19) & (20).
Figure 10A:
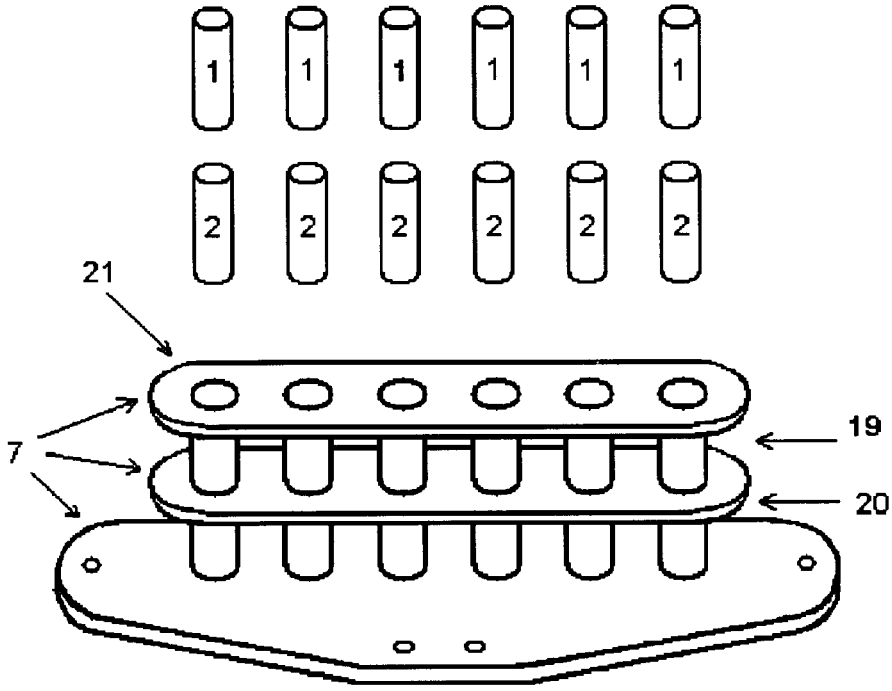
FIG. 10A illustrates a three dimensional view of a plural of magnets (1), and a plural of magnets (2), above former (7).
Figure 10B:
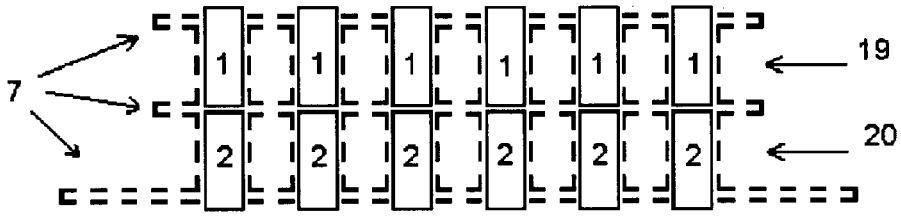
FIG. 10B illustrates a side view of a plural of magnets (1) and a plural of magnets (2), inserted into former (7).

The magnets (1) & (2) are pressed into the holes (21), (see FIGS. 9C, 10A & 10B).

Figure 11A:
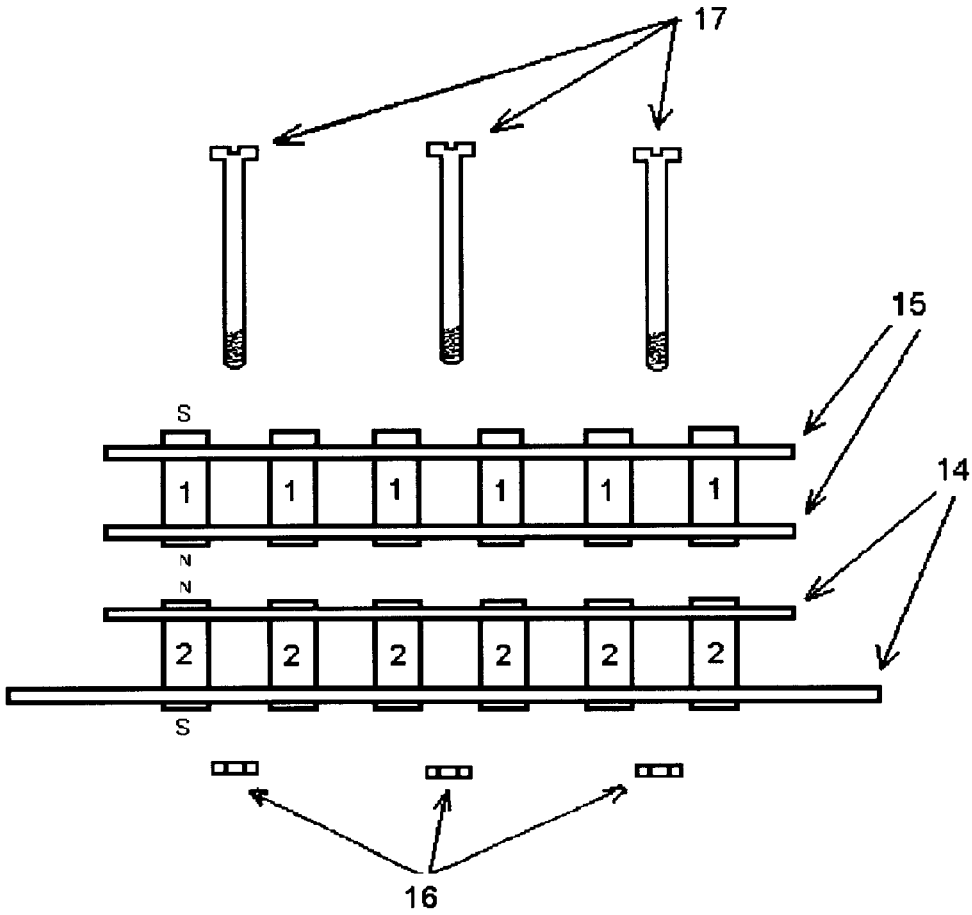
FIGS. 11A & 11B illustrate a method of construction wherein the former is in two sections (14) & (15)
Figure 11B:
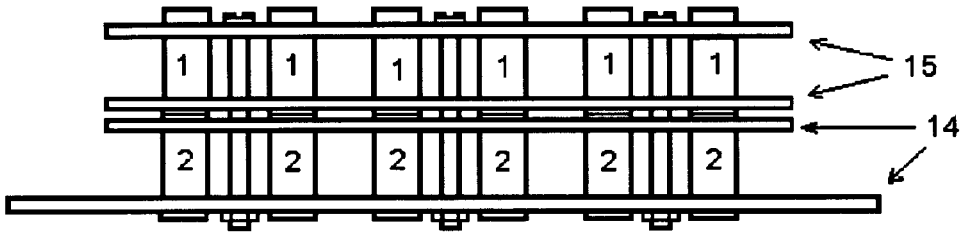

Another form of the invention consists of two formers (14) & (15) with magnets (1) & (2) firmly attached (glued) inside; the two formers are screwed together, with brass screws (17) and nuts (16), (see FIGS. 11A & 11B).

In yet another form of the invention, rare earth magnets (1) & (2) with opposing poles are held against each other (sandwiched together) by pole pieces (8) & (9) made out of ferrous metal. The pole pieces have threads on them and screw into the former (7) on each side, (see FIGS. 12A & 12B). The pole pieces and magnets have coils (3) & (4) around them, in the same arrangement as FIGS. 1A, 2A, 2B & 3A.

For simplicity of manufacture, magnets and pole pieces without threads may be glued or pressed into the former (7).

Figure 12A:
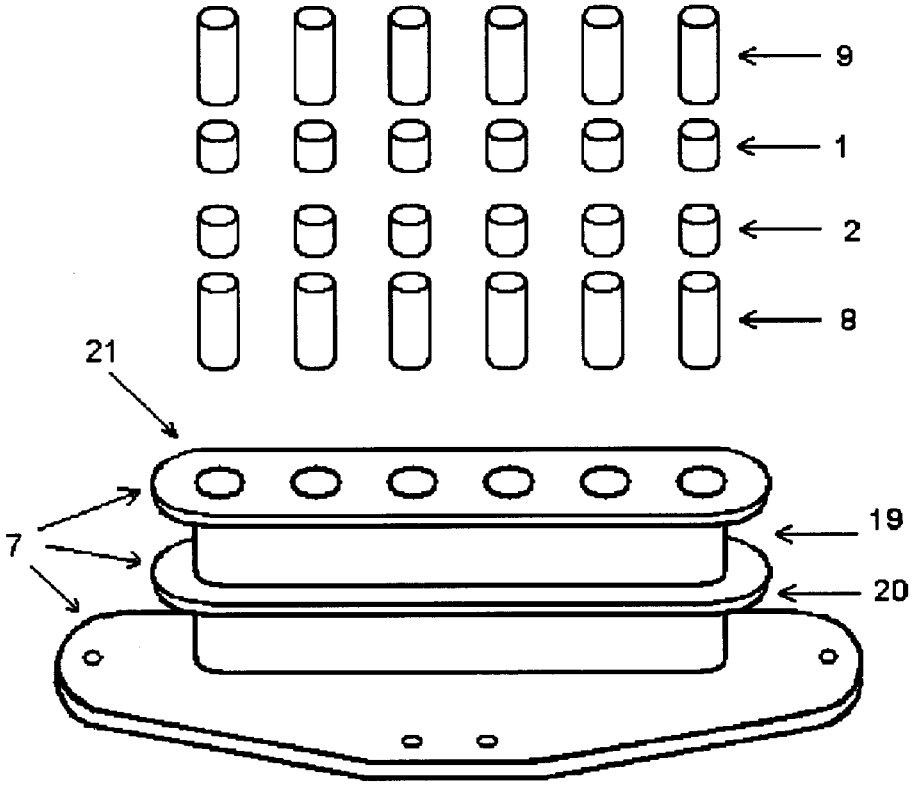
FIG. 12A illustrates a three dimensional view of a plural of magnets (1), plus a plural of pole pieces (9), and a plural of magnets (2), plus a plural of pole pieces (8), above former (7).
Figure 12B:
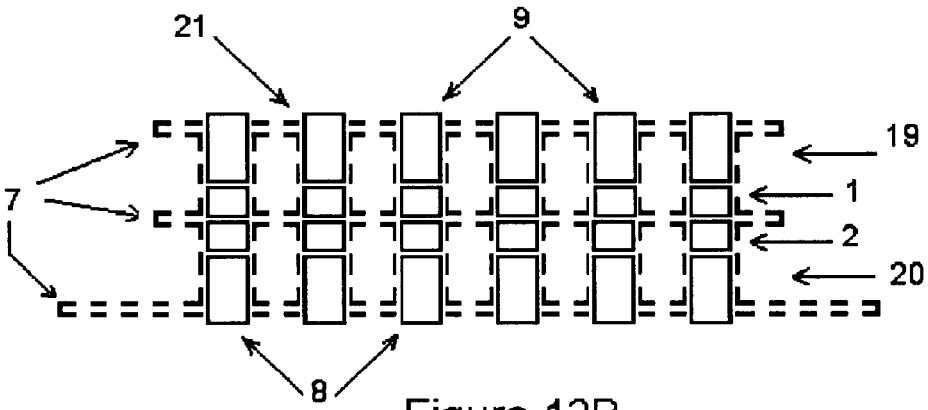
FIG. 12B illustrates a side view of a plural of magnets (1), plus a plural of pole pieces (9), and a plural of magnets (2), plus a plural of pole pieces (8), inserted into former (7).

The magnets (1) & (2) may also be made from any other permanent magnet type material, (see FIGS. 12A & 12B).

Figure 13A:
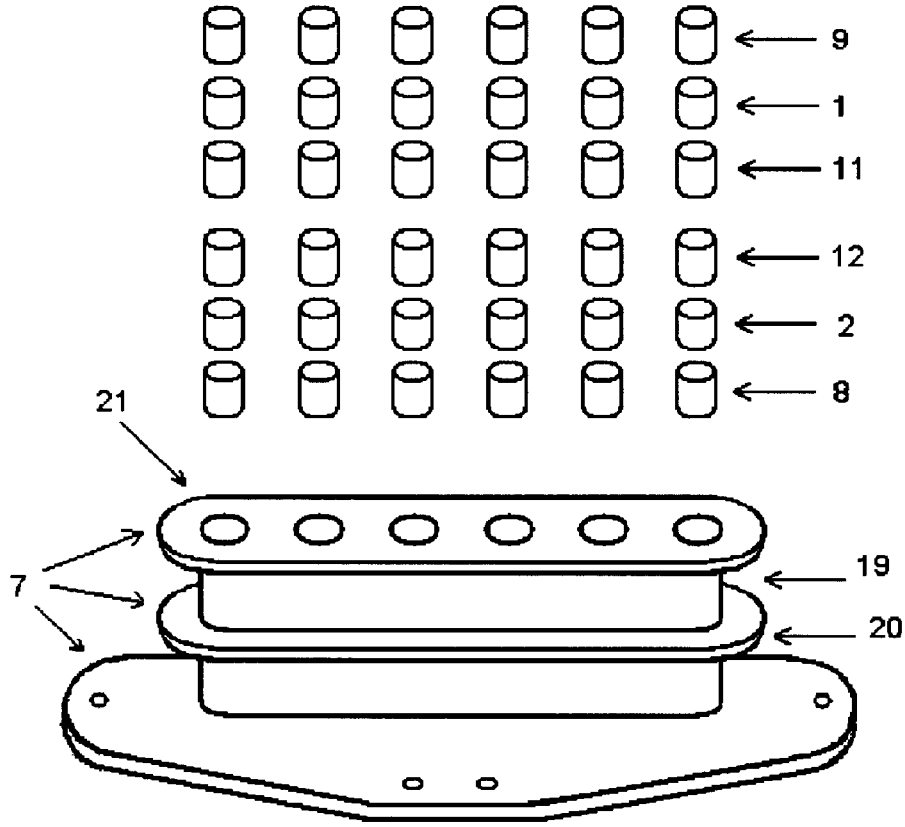
FIG. 13A illustrates a three dimensional view of a plural of magnets (1), plus a plural of pole pieces (9), plus a plural of pole pieces (11), and a plural of magnets (2), plus a plural of pole pieces (8), plus a plural of pole pieces (12), above former (7).
Figure 13B:
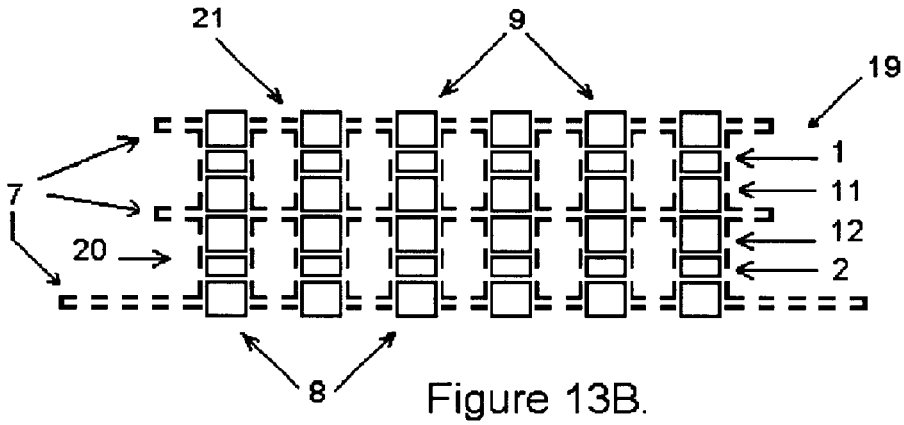
FIG. 13B illustrates a side view of a plural of magnets (1), plus a plural of pole pieces (9), plus a plural of pole pieces (11), and a plural of magnets (2), plus a plural of pole pieces (8), plus a plural of pole pieces (12), inserted into former (7).

There may be an advantage in using rare earth magnets in that they stay magnetised longer, although they will give a slightly different sound than alnico magnets, as the shape of the magnetic flux is slightly different. The life of the magnets may be improved by placing more pole pieces (11) & (12) between the magnets (1) & (2), (see FIGS. 13A & 13B).

Figure 14A:
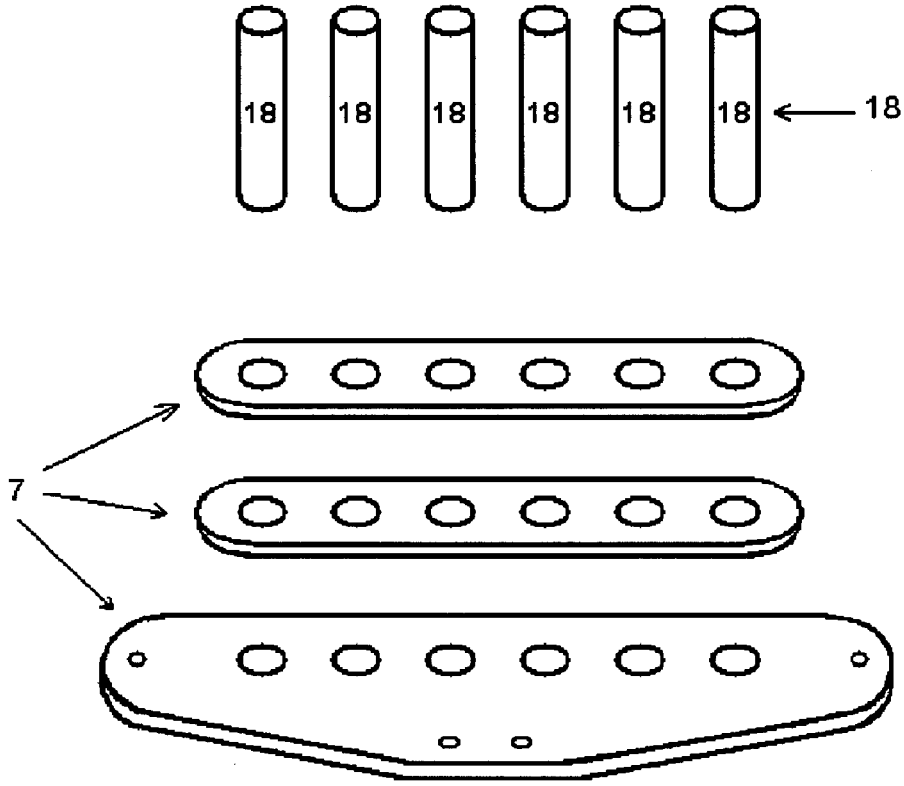
FIGS. 14A & 14B illustrate a Former (7), wherein the tubular sections (18), of the former (7), are constructed with separate tubular members.
Figure 14B:
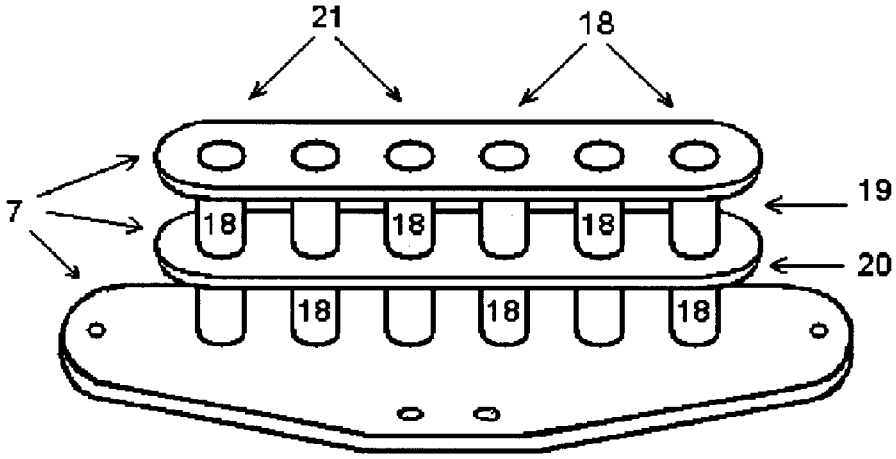

Another method is to construct the tubular sections (18) of the former (7) out of thin brass or some other non-ferrous metal. Threads are taped into the tubular sections of the former so that the magnets or magnets and pole pieces can be screwed in tightly, (see FIGS. 14A &14B). Alternatively the magnets, or magnets & pole pieces could be pressed or glued into the tubular sections (18). The tubular sections (18) may also be constructed of nylon pressure tube or similar material.

Figure 15A:
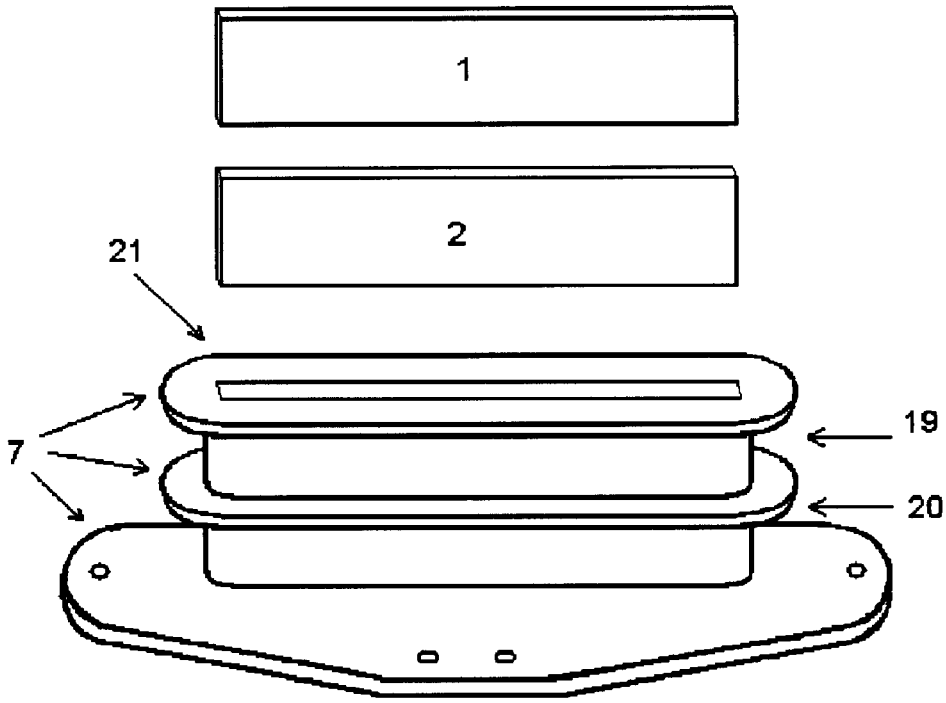
FIG. 15A illustrates a three dimensional view of magnet (1), and magnet (2), above former (7).
Figure 15B:
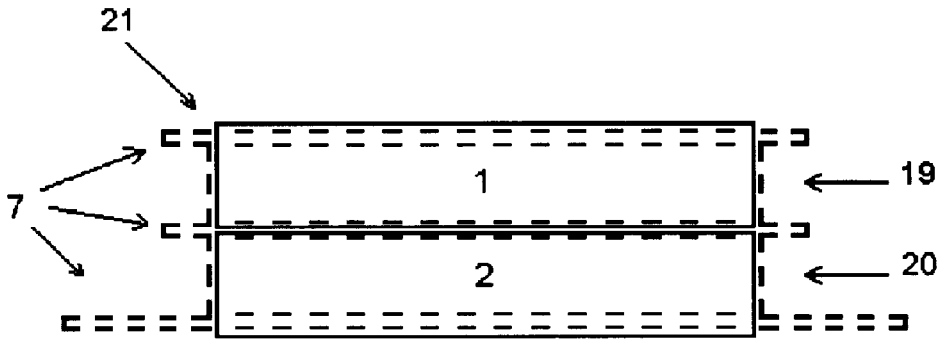
FIG. 15B, illustrates a side view of magnet (1), and magnet (2), inserted into former (7).

In another form of the invention with only two permanent magnets, there is a slot (21) through the center of former (7) where the permanent magnets (1) & (2) are pressed into the former (7), (see FIGS. 15A & 15B). There are also coils wound into the cavities (19) & (20) of the former (7), (see FIG. 1B).

Figure 16A:
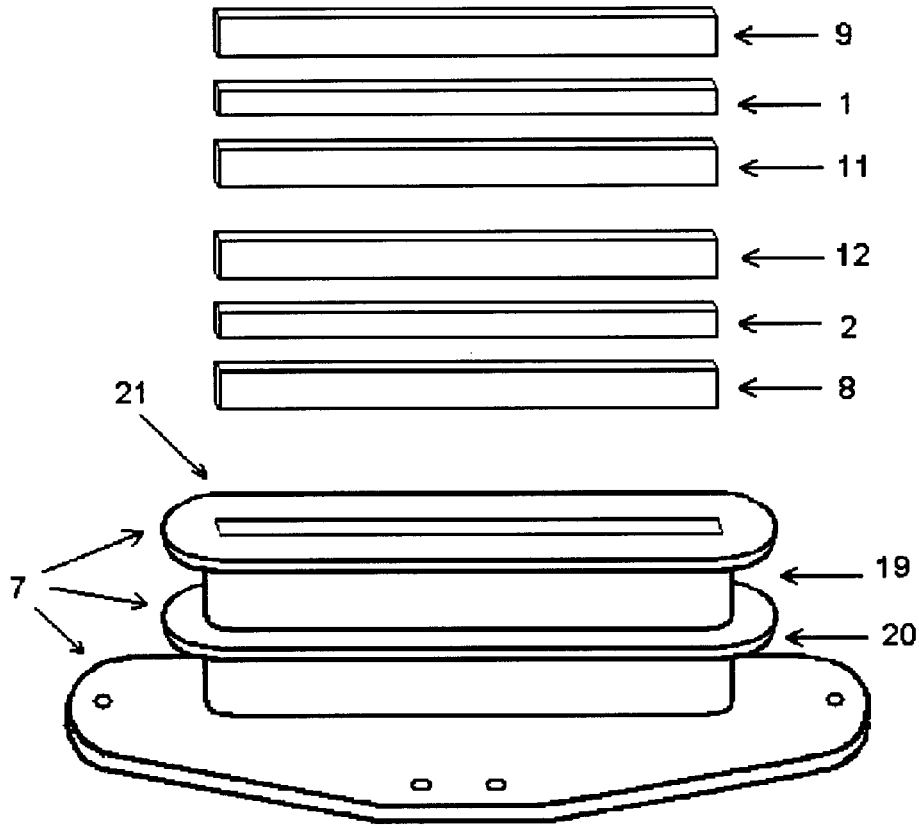
FIG. 16A illustrates a three dimensional view of magnet (1), plus pole piece (9), plus pole piece (11), and magnet (2), plus pole piece (8), plus pole piece (12), above former (7).
Figure 16B:
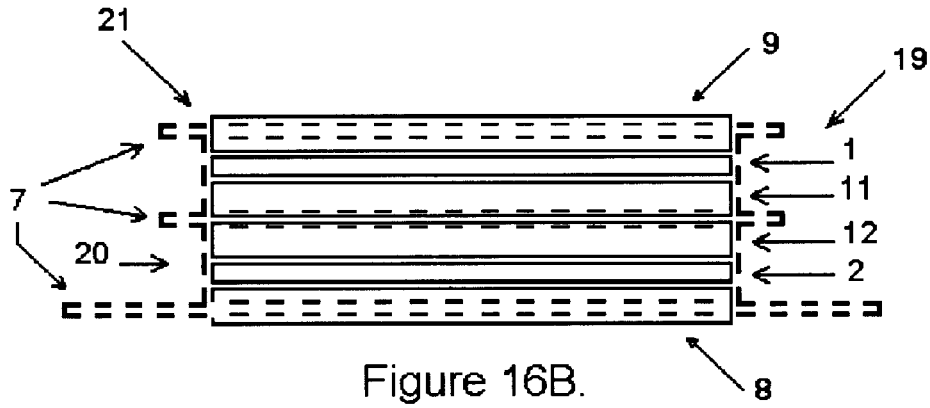
FIG. 16B illustrates a side view of magnet (1) plus pole piece (9), plus pole piece (11), and magnet (2), plus pole piece (8), plus pole piece (12), inserted into former (7).

In a similar form of the invention with only two magnets there are ferrous pole pieces (9) & (11) disposed coaxially at each magnetic pole of permanent magnet (1) and ferrous pole pieces (12) & (8) disposed coaxially at each magnetic pole of permanent magnet (2), that are pressed into former (7), (see FIGS. 16A and 16B). There are coils of wire wound into the cavities (19) & (20) of the former (7), (see FIG. 1B).

The former or formers are made of teflon, plastic, fiberglass, paxolin, fiberboard or similar material. The magnets are made of alnico magnets, rare earth magnets or any other type of permanent magnet. The coils are made of copper wire or some other nonferrous wire.

Other methods of construction of the configuration of this device are deemed to be within the scope of the present invention.

What is claimed is:

1. An electromagnetic pick-up for stringed musical instruments comprising a first permanent magnet means on top of a second permanent magnet means, a first wire coil means around the first permanent magnet means, a second wire coil means around the second permanent magnet means, wherein the magnetic polarization of the first permanent magnet means opposes the magnetic polarization of the second permanent magnet means, wherein the first permanent magnet means generates a first magnetic field and the second permanent magnet means generates a second magnetic field, wherein the first wire coil means and the second wire coil means have a common axis perpendicular to a set of ferrous strings, wherein both permanent magnet means is situated in a way that only the magnetic flux at the top of the first permanent magnet means reaches out to a set of ferrous strings, wherein vibrating ferrous metal strings cause a fluctuation in the first magnetic field that is relayed through to the second magnetic field and thus producing an alternating electric current in both wire coil means, including a means of a former elongated in shape, having at least one hole in the top extending through to the bottom whereinto the said first permanent magnet means and the said second permanent magnet means are situated, the former having a upper cavity extending in a full circle around the sides of the upper half, whereinto the said first wire coil means is disposed, the former having a lower cavity extending in a full circle around the sides of the lower half, whereinto the said second wire coil means is disposed.

2. A electromagnetic pick-up for stringed musical instruments of claim 1 wherein the first permanent magnet means comprises only one magnet and the second permanent magnet means comprises only one magnet.

3. A electromagnetic pick-up for stringed musical instruments of claim 1 wherein the first permanent magnet means comprises a plural of magnets and the second permanent magnet means comprises only one magnet.

4. A electromagnetic pick-up for stringed musical instruments of claim 1 wherein the first permanent magnet means comprises only one magnet and the second permanent magnet means comprises a plural of magnets.

5. A electromagnetic pick-up for stringed musical instruments of claim 1 wherein the first permanent magnet means comprises a plural of magnets and the second permanent magnet means comprises a plural of magnets.

6. A electromagnetic pick-up for stringed musical instruments as claimed in claim 1, wherein the first wire coil means and the second wire coil means comprise leads that are free to be wired either in-series or in-parallel; out-of-phase with respect to EMF and in-phase with respect to string signal.

7. A electromagnetic pick-up for stringed musical instruments as claimed in claim 1, wherein the first wire coil means and the second wire coil means comprise leads that are pre-wired either in-series or in-parallel; out-of-phase with respect to EMF and in-phase with respect to string-signal.

8. A electromagnetic pick-up for stringed musical instruments as claimed in claim 1, wherein either or both wire coil means comprises a coil that is tapped or divided into a plural of coils.

9. A electromagnetic pick-up for stringed musical instruments as claimed in claim 1, wherein either or both wire coil means comprises a coil that is not tapped or divided into a plural of coils.

10. A electromagnetic pick-up for stringed musical instruments as claimed in claim 1, wherein the first permanent magnet means comprises the same permeability as that comprised by the second permanent magnet means.

11. A electromagnetic pick-up for stringed musical instruments as claimed in claim 1, wherein the first permanent magnet means comprises a different permeability to that comprised by the second permanent magnet means.

12. A electromagnetic pick-up for stringed musical instruments as claimed in claim 1, wherein the first wire coil means comprises a gauge of wire that is the same as the gauge of wire that is comprised by the second wire coil means.

13. A electromagnetic pick-up for stringed musical instruments as claimed in claim 1, wherein the first wire coil means comprises a gauge of wire that is different to the gauge of wire that is comprised by the second wire coil means.

14. A electromagnetic pick-up for stringed musical instruments as claimed in claim 1, wherein the number of turns that is comprised by the first wire coil means is the same as the number of turns that is comprised by the second wire coil means.

15. A electromagnetic pick-up for stringed musical instruments as claimed in claim 1, wherein the number of turns that is comprised by the first wire coil means is different to the number of turns that is comprised by the second wire coil means.

16. A electromagnetic pick-up for stringed musical instruments as claimed in claim 1, wherein active circuitry is not required.

17. A electromagnetic pick-up for stringed musical instruments as claimed in claim 1, wherein active circuitry is provided.

18. A electromagnetic pick-up for stringed musical instruments as claimed in claim 1, wherein a third or fourth or more permanent magnet means and wire coil means are cascaded together, with the first and second permanent magnet means and wire coil means, to form a device comprising of three or four or more permanent magnet means and wire coil means stacked one on top of the other, wherein the magnetic polarization of each permanent magnet means opposes the magnetic polarization of the permanent magnet means above or below therein.

19. A electromagnetic pick-up for stringed musical instruments as claimed in claim 1, wherein the first permanent magnet means, incorporate one or more ferrous pole pieces.

20. A electromagnetic pick-up for stringed musical instruments as claimed in claim 1, wherein the second permanent magnet means, incorporate one or more ferrous pole pieces.

21. A electromagnetic pick-up for stringed musical instruments of claim 1, wherein a means of a former is constructed from:

plates situated at each end of a first permanent magnet means, forming a first hiatus whereinto a first wire coil means is disposed;

and plates situated at each end of a second permanent magnet means, forming a second hiatus whereinto a second wire coil means is disposed;

or a means of a former constructed from one or more tubular sections whereinto a first permanent magnet means and a second permanent magnet means are situated;

and having plates situated at each end and spaced along the tubular sections;

forming a first hiatus whereinto a first wire coil means is disposed;

and forming a second hiatus whereinto a second wire coil means is disposed;

or a means of a former constructed from one mass of material forming a former in one piece having a first hiatus whereinto a first wire coil means is disposed;

and forming a second hiatus whereinto a second wire coil means is disposed.

* * * * *